US006045437A

United States Patent [19]

Tandon et al.

[11] Patent Number: 6,045,437

[45] Date of Patent: Apr. 4, 2000

[54] METHOD AND APPARATUS FOR POLISHING A HARD DISK SUBSTRATE

[75] Inventors: Sham Tandon; Suman Tandon, both of Saratoga; Ram Seshan, Roseville, all of Calif.

[73] Assignee: Tan Thap, Inc., Santa Clara, Calif.

[21] Appl. No.: 08/804,053

[22] Filed: Feb. 21, 1997

Related U.S. Application Data

[60] Provisional application No. 60/012,891, Mar. 1, 1996.

[51] Int. Cl.[7] ..... B24B 5/00; B24B 29/00

[52] U.S. Cl. ..... 451/288; 451/446; 451/60

[58] Field of Search ..... 451/268, 269, 451/291, 292, 36, 41, 285, 287, 289, 57, 60, 37, 63, 42, 28, 446; 156/636.1

[56] References Cited

U.S. PATENT DOCUMENTS

| | | | |
|---|---|---|---|
| 2,401,953 | 6/1946 | McCain | 451/269 |
| 2,618,911 | 11/1952 | Indge | 451/269 |
| 3,541,734 | 11/1970 | Clar | 451/269 |
| 3,845,587 | 11/1974 | Klievoneit | 451/269 |
| 4,217,734 | 8/1980 | Frei | 451/269 |
| 4,272,924 | 6/1981 | Masuko et al. | 451/269 |
| 4,502,252 | 3/1985 | Iwabuchi | 451/269 |
| 5,533,923 | 7/1996 | Shamouilian et al. | 451/36 |
| 5,645,472 | 7/1997 | Nagahashi et al. | 451/269 |

FOREIGN PATENT DOCUMENTS

| | | | |
|---|---|---|---|
| 363114871 | 5/1988 | Japan | 451/290 |
| 14926 | 12/1990 | WIPO | 451/290 |

*Primary Examiner*—Timothy V. Eley
*Assistant Examiner*—Derris Holt Banks
*Attorney, Agent, or Firm*—Skjerven, Morrill, MacPherson, Franklin and Friel; David E. Steuber

[57] ABSTRACT

Substrates to be used in manufacturing hard disks are polished in a two-step process entailing a coarse and fine polishing in a single polishing machine. The use of this method and apparatus eliminates the need for two separate polishing machines and for transferring the disks from one polishing machine to another. Furthermore, the overall quality of hard disk substrates polished by this method and apparatus, including smoothness, flatness and edge roll-off, is superior to that achieved by the prior art.

13 Claims, 8 Drawing Sheets

Front View

METHOD AND APPARATUS FOR POLISHING A HARD DISK SUBSTRATE

CROSS-REFERENCE

This application claims the priority of provisional application Ser. No. 60/012,891, filed Mar. 1, 1996, entitled "Method and Apparatus for Polishing a Nickel Substrate".

BACKGROUND OF INVENTION

1. Field of the Invention

This invention relates to the manufacture of electronic storage media; in particular, this invention relates to polishing hard disk substrates used in computer memory hard disk drives.

2. Description of the Prior Art

Because of their speed and efficiency in storing, retrieving, and manipulating data, electronic computers are a necessity in most business and home environments. The computer's speed depends in part on the time it takes to access data in the computer's memory. When the data are stored on a hard disk, the speed depends on both the rotational speed of the hard disk and the speed of the mechanical arm that positions the read-write head over the hard disk.

Data is written to a hard disk by using a magnetic field generated at the read-write head to align magnetic domains on the hard disk surface in a defined direction. Data is read from a hard disk in a reverse manner, by using magnetic domains to induce a magnetic field in the read-write head; the magnetic field is converted to an electrical signal that is decoded in a known manner. If the read-write head is positioned close to the hard disk surface, a smaller area on the hard disk surface is required to induce a magnetic field on the read-write head, and a smaller area on the hard disk will be magnetized by the read-write head. Accordingly, more data in the form of aligned magnetic domains can be packed onto a hard disk if the read-write head is suspended closer to the surface of the hard disk. Because plated or sputtered magnetic hard disk surfaces can hold smaller magnetic domains, they are preferred over iron oxide-coated surfaces for high-density storage.

FIG. 1 illustrates the layers of materials that make up a hard disk 100. First, a hard disk substrate (also called an aluminum blank) 110 is fabricated to give the hard disk structure its basic form. Substrate 110 is formed with a center hole 110*a* to accommodate a spindle for rotating the hard disk. Next, a layer 120 of nickel phosphorous approximately 450–550 micro-inches thick is deposited on substrate 110 using electroless plating or other known techniques; nickel phosphorous layer 120 provides a good base for the deposition of a magnetic layer 130, approximately 250–300 Å thick, which is sputter-deposited on top of the nickel phosphorous layer 120. Magnetic layer 130, typically composed of cobalt-nickel, has magnetic domains whose orientation, as discussed above, represents the data stored on the hard disk. Next, a graphite overcoat 140 approximately 50–100 Å thick, which decreases corrosion and wear, is sputter-deposited on magnetic layer 130. Finally, a lubricant 150 is coated over the surface of graphite overcoat 140. Lubricant 150 protects against "stiction," which occurs when the read-write head sticks to the surface of the hard disk. This occurs when the spindle supporting the hard disk has been stationary for an extended time, i.e., the hard disk has not been read from or written to, and the read-write head has been "parked" on the surface of the hard disk. When the hard disk is later rotated, the read-write head sticks to the surface of the hard disk, and when the read-write arm is moved over the surface of the hard disk to a data location, the read-write head can damage both itself and the data stored on the hard disk. Using lubricant 150, when the hard disk begins to rotate, the read-write head easily disengages from the hard disk surface and can soon fly above the hard disk surface.

In one version, disk 100 has an outside diameter of 95 mm and a thickness of 0.8 mm, and center hole 110*a* has a diameter of 25 mm.

The read-write head can be moved to different locations over the hard disk surface (to access data at these locations) by extending or retracting a mechanical arm so as to move the read-write head in a plane parallel to the hard disk. The combination of one or more disks, read-write heads, arms, and associated circuitry is called a head-disk assembly, or HDA. The read-write heads are suspended above the hard disks as they move to each location where data is to be stored or retrieved; this suspension is created by air flows which are created as the disk rotates. The hard disk is attached to and rotated by a spindle motor, and the rotation creates an aerodynamic lift that suspends the read-write head (formed on an aerodynamically shaped slider) above the hard disk; the faster the hard disk rotates, the higher the read-write head is suspended above the rotating hard disk. Presently, hard disks rotate at approximately 5400 r.p.m. to 7200 r.p.m.; read-write heads, once suspended 30$\mu$ in. above the surface of the hard disk are now, because of technological advances, suspended approximately 2$\mu$ in. above the surface of the hard disk.

FIG. 2 shows a portion of a head-disk assembly 200 used in a computer memory system. In FIG. 2, hard disks 210 are attached to and rotate in parallel planes on a spindle 220. Read-write heads 230 are attached to read-write arms 240 which move the read-write heads to locations along the surfaces of hard disks 210.

As discussed above, improvements in data-storage efficiency demand that the read-write head not fly too far above the surface of the hard disk. This low flying height demands that the surface of the hard disk be as smooth as possible, without large peaks and valleys. If the surface of the hard disk contains large peaks, the read-write head will crash into the peaks as the hard disk rotates. When this happens, the read-write head will be irreparably damaged as the result of the "head crash."

From the above discussion, it is clear that a smooth, hard disk surface is critical if the head-disk assembly is to perform properly. A smooth surface is achieved by "planetary polishing machines" which buff and polish the surface of the nickel phosphorous-plated hard disk substrate before the magnetic layer, graphite overcoat, and lubricant are added. To achieve a smooth hard disk surface, the plated substrate has to be polished to a high degree of surface finish. The magnetic layer cannot be polished because doing so would destroy its magnetic properties. The graphite overcoat and the lubricant do not have to be polished because they are thin and conform to the shape of the underlying structure.

The prior art used two or more separate planetary polishing machines: one to rough cut the top and bottom surfaces of the plated substrate (initial polishing), and another to polish the top and bottom surfaces of the plated substrate (final polishing). The first planetary polishing machine secured the plated substrates and introduced a slurry, a semi-liquid combination containing water mixed with an abrasive grit, into a polishing chamber where the plated substrates were held. The hard disk substrates were then rotated with respect to polishing pads located above and below the hard disk substrates to rough cut them and remove asperities. (It does not matter whether the hard disk substrates or the polishing pads rotate, as long as one moves relative to the other.) The first planetary polishing machine polished the largest ripples on the hard disk substrate surface and thus required a slurry having a coarse (large-grained) grit. The second planetary polishing machine polished the top and bottom surfaces of the plated substrates to smaller tolerances, and thus required a slurry having a finer (smaller-grained) grit. A two-step process using both coarse and fine-grit abrasives was necessary to achieve the required tolerances: if only a coarse-grit abrasive were used, the required smoothness could not be achieved; if only a fine-grit abrasive were used, the polishing would take too long and would cause the flatness and roll-off at the edge of the disk to exceed allowed tolerances.

To solve this problem, some prior art polishing processes experimented with using a single coarse-grained slurry in both the initial and final polishing stages, and merely diluted the slurry from the initial polishing stage for use in the final polishing stage. However, these processes failed to achieve the required smoothness.

Other prior art polishing processes used two or more planetary polishing machines, so that slurries would not be mixed. This was necessary because slurries could not be easily removed from the polishing chamber. If any large-grained grit from the initial polishing stage remained in the polishing chamber (in the pores of the polishing pads, for example) during final polishing, the substrate would be too deeply scratched by individual particles of large-grained grit and could not meet the required smoothness tolerances. To overcome this limitation, prior art polishing processes required that each machine use only one slurry. If two slurries were required, two machines were also required. Precautions had to be taken to prevent cross-contamination of the slurries between the two machines. For this reason, the machines were sometimes located in different rooms.

Prior art planetary polishing machines include Speedfam Double Sided Machines, model numbers DSM 16B-5P-II (Planetary Polishing Machine), DSM 18B-5P (Planetary Polishing Machine), DSM 13B-9B (Planetary Disk Polishing System), and DSM 16B-5P (Planetary Polishing System). These machines are not designed to allow different slurries to be used in different stages of the polishing process.

Using two machines to polish hard disk substrates has several drawbacks. For example, because the process uses two machines, it has additional purchase and maintenance costs. Second, the process requires that hard disk substrates be transferred between polishing machines; this additional handling adds time to the polishing process and exposes the hard disk substrates to operator mishandling errors and handling damage.

For the above reasons, there exists a need to reduce the time, the expense, and the exposure of operator error involved in polishing hard disk substrates where a high degree of surface finish is required.

SUMMARY OF THE INVENTION

According to this invention, a single planetary polishing machine is adapted to supply a large-grit slurry during an initial polishing stage and a small-grit slurry during a final polishing stage, the initial and final polishing stages being separated by a rinse cycle. Separate inlet lines are provided for the large-grit slurry, small-grit slurry and rinse liquid.

According to the method of this invention, in the initial polishing stage, a large-grit slurry is introduced into the polishing chamber, where the hard disk substrates are rotated against polishing pads (or vice-versa). During the initial polishing stage, the abrasive particles in the large-grit slurry are broken into smaller particles. At the completion of the initial polishing stage, an intermediate rinse cycle is performed to rinse the first slurry from the polishing chamber. In the final polishing stage, a fine-grit slurry is introduced into the polishing chamber, and the hard disk substrates are rotated against the polishing pads. In a final rinse cycle, the second slurry is rinsed from the polishing chamber, and the hard disk substrates are removed from the polishing chamber and stored for later processing.

By properly controlling the process variables, the large-grit slurry performs its function of polishing the hard disk to a desired degree of smoothness, while the abrasive particles within the large-grit slurry are sufficiently broken up during the initial polishing stage that they are readily removed from the machine during the rinse cycle, and any portions thereof remaining at the conclusion of the rinse cycle do not unduly abrade the surfaces of the disk during the final polishing stage.

DETAILED DESCRIPTION

Figure 1:
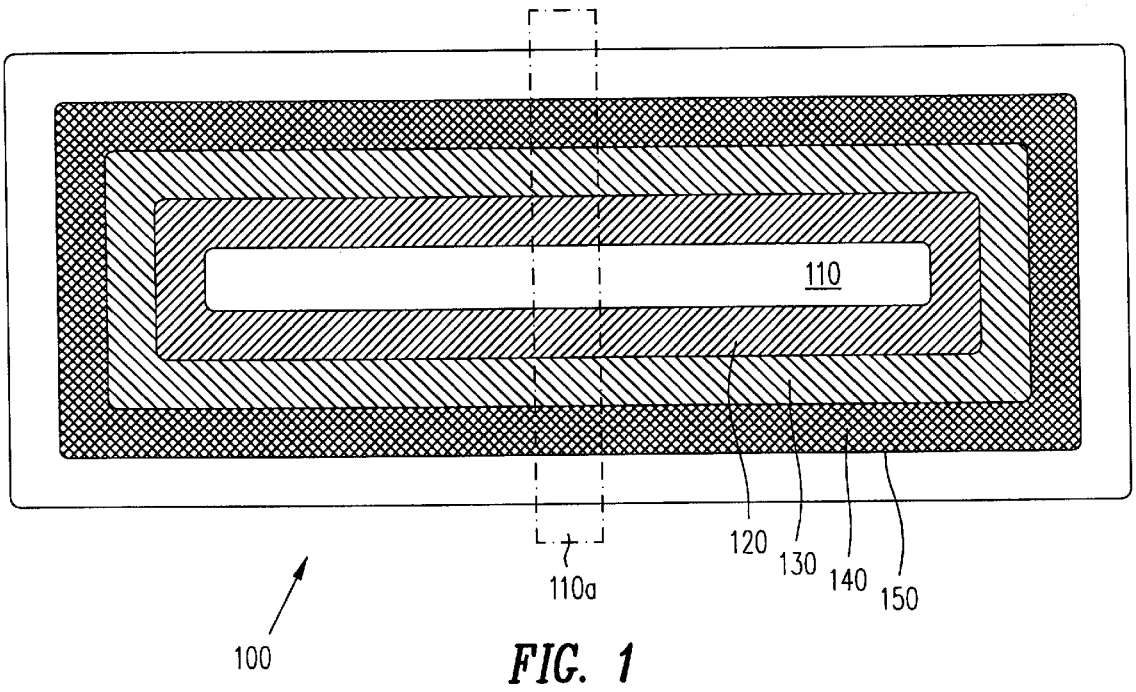
FIG. 1 is a cross-sectional view of a finished hard disk used in a computer hard disk drive.
Figure 2:
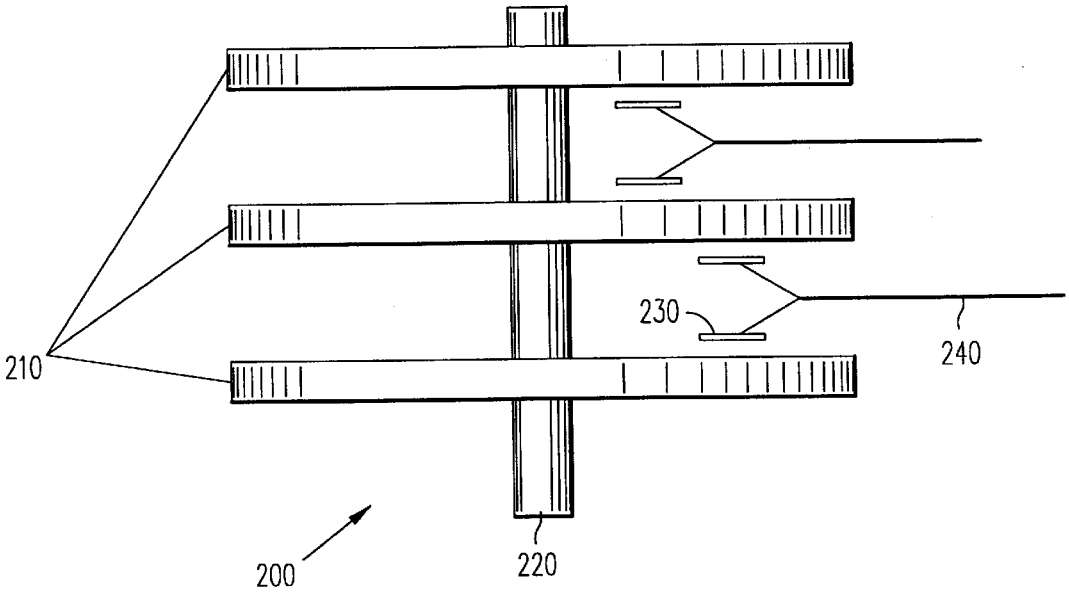
FIG. 2 is a schematic cross-sectional view of a portion of a head disk assembly.
Figure 3A:
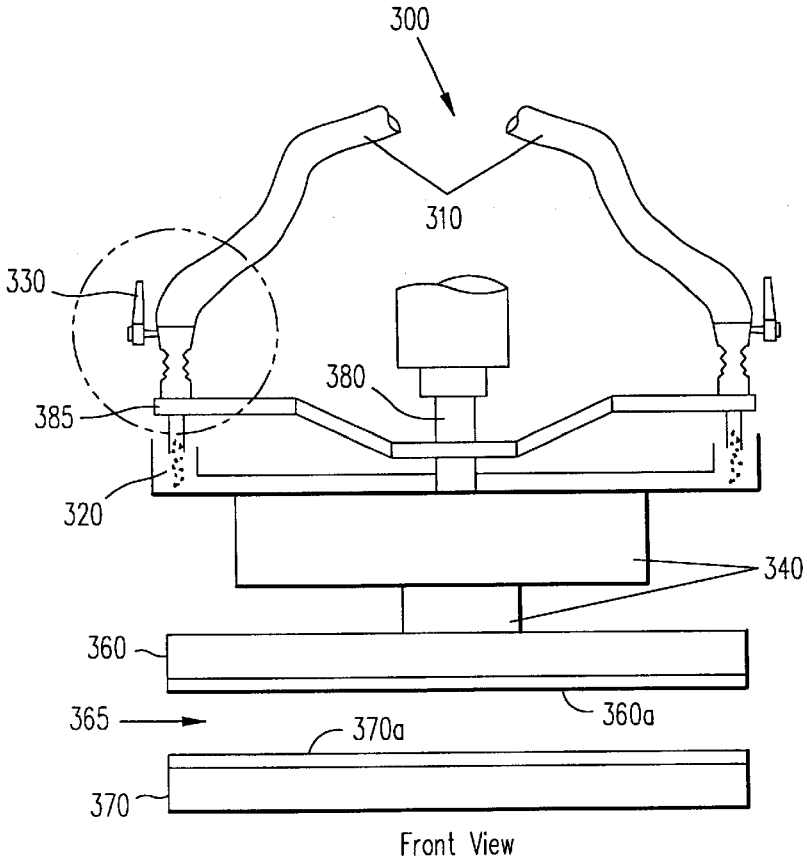
FIG. 3*a* is a cut-away view of a planetary polishing machine in accordance with the present invention.
Figure 3B:
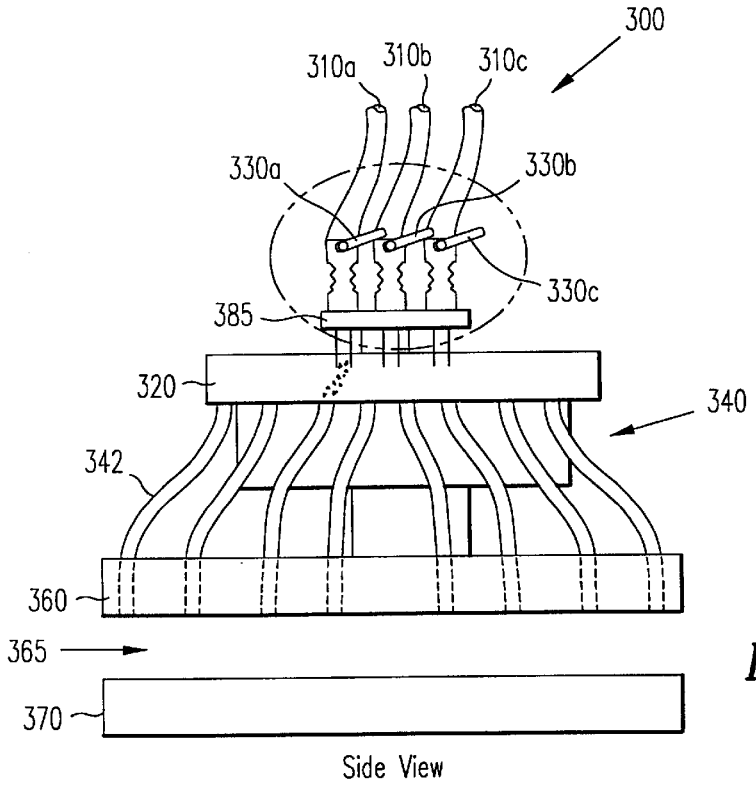
FIG. 3*b* is a side view of the machine in FIG. 3*b*.
Figure 3C:
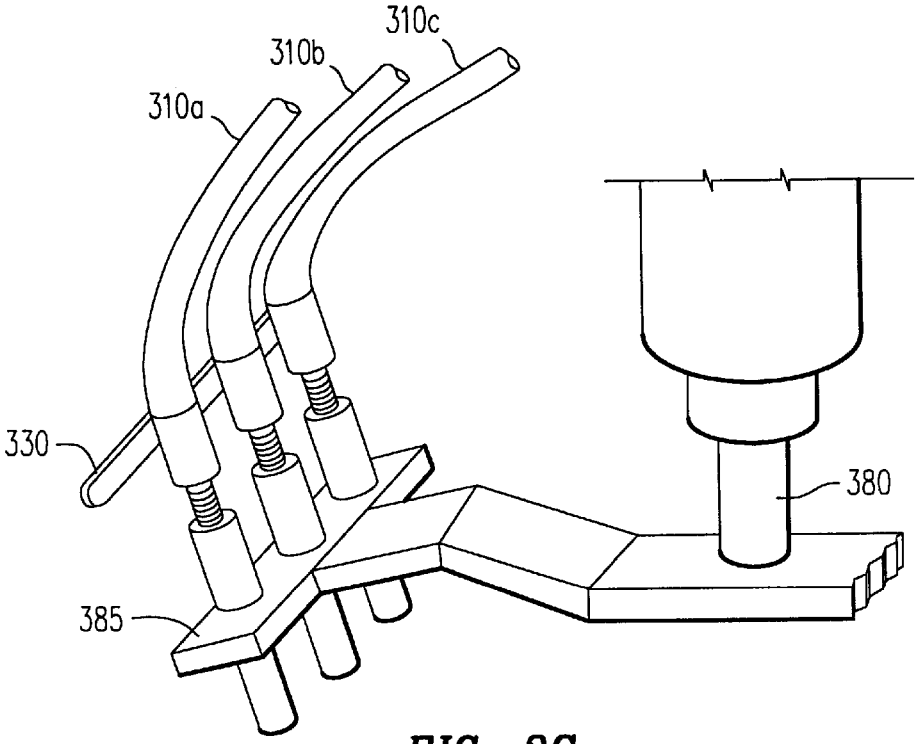
FIG. 3*c* is a magnified view of a portion of the machine in FIG. 3*a*.

FIG. 3*a* shows a front view, FIG. 3*b* a side view, and FIG. 3*c* a magnified view of portions of a planetary polishing machine 300 in accordance with the present invention. Like reference numbers refer to like components. In FIGS. 3*a* and 3*b*, a slurry mixture is transported down flexible tubes 310, which include a flexible tube 310*a* for carrying a first slurry mixture, a flexible tube 310*b* for carrying a second slurry mixture, and a flexible tube 310*c* for carrying a rinse. Flexible tubes 310*a*, 310*b*, and 310*c* are connected at their upstream ends to sources of both slurry mixtures and rinse water, and are supported at their downstream ends by a tube support 385. Tubes 310*a*, 310*b* and 310*c* are used to introduce a coarse slurry, a fine slurry and rinse water, respectively, to polishing machine 300.

The first and second slurry mixtures and rinse are delivered into a circular trough 320 and then flow through holes in the bottom of circular trough 320. The amount of slurry delivered to circular trough 320 is controlled by an external programmable controller (not shown) that actuates solenoid valves 330*a,* 330*b,* 330*c,* attached to flexible tubes 310*a,* 310*b,* and 310*c,* respectively. Circular trough 320 is attached at its center to machine spindle 380, which is rotated by a motor (not shown). Machine spindle 380 rotates circular trough 320 with respect to flexible tubes 310 and ensures that the first and second slurry mixtures and the rinse are uniformly spread about the surface of circular trough 320 and thus evenly distributed through the holes in the bottom of circular trough 320. A circular trough support 340 supports circular trough 320.

After passing through the holes in circular trough 320, the slurry mixtures and rinse flow through flexible tubes 342 and then through passages in upper platen 360, and thus into a polishing chamber 365 between upper platen 360 and lower platen 370. The slurry mixtures and rinse are evenly spread throughout polishing chamber. Upper platen 360 supports a polishing pad 360*a,* which covers the entire lower surface of upper platen 360, and lower platen 370 supports a polishing pad 370*a,* which covers the entire upper surface of lower platen 370. As will be discussed below, lower platen 370 supports carriers 373 (shown in FIG. 4*a*) that secure hard disk substrates and that rotate with respect to polishing pads 360*a* and 370*a,* thus polishing the hard disk substrates. Upper platen 360, lower platen 370 and carriers 373 are components of the Speedfam model 16B, which is used in one enbodiment of this invention and the structure and operation of which are well known to those skilled in the art.

Figure 4A:
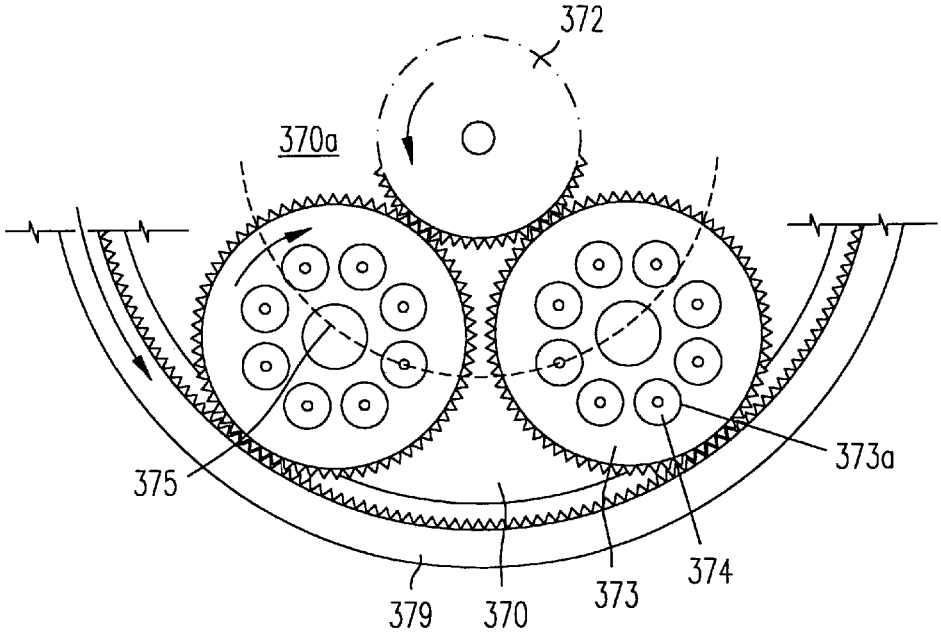
FIG. 4*a* is a magnified top view of a portion a bottom platen which secures hard disk substrates in accordance with the present invention.
Figure 4B:
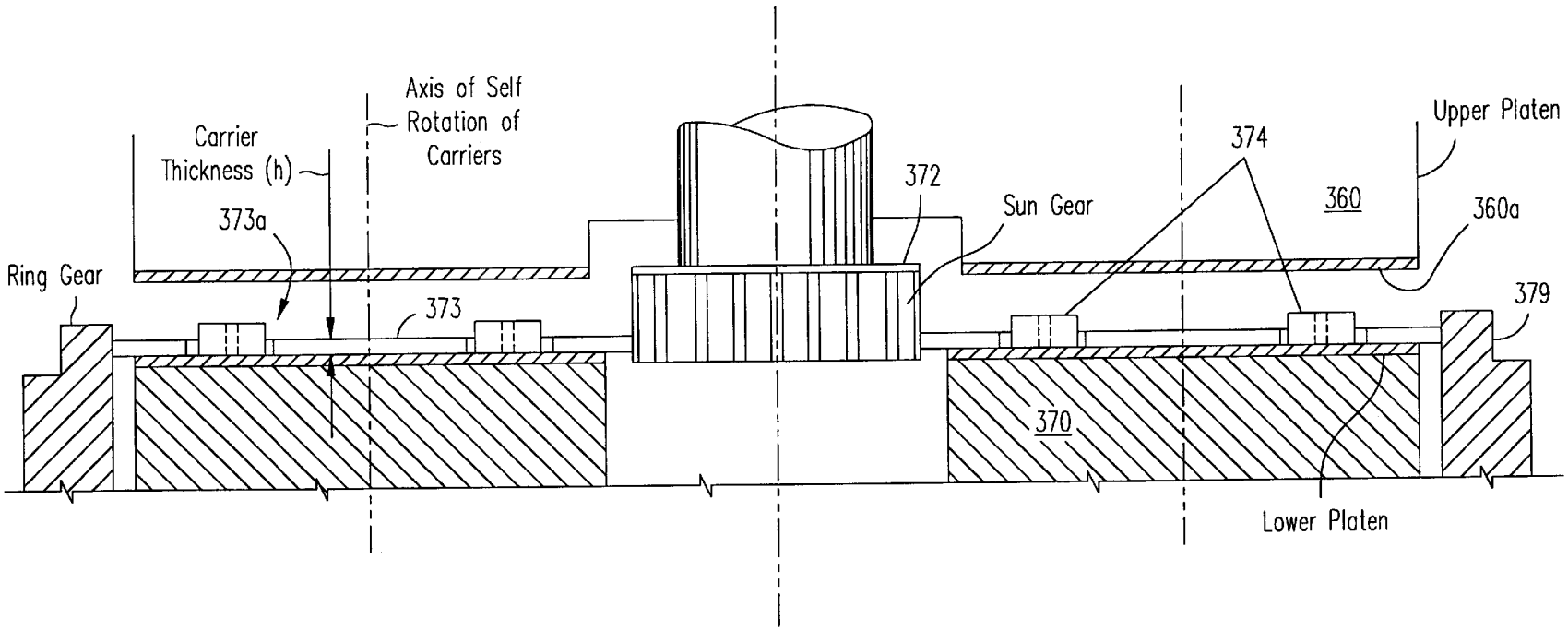
FIG. 4*b* is a side view of a portion of a top platen and a bottom platen which secure hard disk substrates in accordance with the present invention.

FIG. 4*a* shows a top view of a portion of lower platen 370 (covered by polishing pad 370*a*), and FIG. 4*b* shows a side view of upper platen 360 and lower platen 370. Each of carriers 373 is a planar circular structure with circular pockets 373*a* formed therein. Pockets 373*a* have diameters slightly greater than the diameters of the hard disk substrates 374, allowing the hard disk substrates 374 to rotate freely inside the pockets 373*a*. Carriers 373 have a height "h" that is less than the thickness of hard disk substrates 374, so that when upper platen 360 is lowered towards lower platen 370 polishing pad 360*a* rests upon the upper surfaces of hard disk substrates 374. Similarly, the lower surfaces of hard disk substrates 374 rest upon polishing pad 370*a*. The upper and lower surfaces of hard disk substrates 374 are then polished by rotating carriers 373, since this movement also rotates hard disk substrates 374 against the polishing pads 360*a* and 370*a*.

The rotation of carriers 373 is accomplished by the mechanism shown in FIG. 4*a*. The outer perimeter of each carrier 373 is toothed and meshes with a ring gear 379 which is located outside the perimeter of lower platen 370. Carriers 373 also mesh with a sun gear 372. Sun gear 372 is mated to spindle 380 so that spindle 380 and sun gear 372 rotate together. As sun gear 372 rotates independent of ring gear 379, each of carriers 373 rotates about its own central axis (carrier self-rotation) and rotates about the axis of the sun gear 372 (carrier global rotation). For example, when sun gear 372 rotates in a counter clockwise direction and the ring gear 379 also rotates in a counter clockwise direction (at a slower speed), carriers 373 rotate in a clockwise direction about their own axes and counter clockwise about the axis of the sun gear 372. Lower platen 370 rotates in the same direction as the ring gear 379 and at approximately three times the rotational speed of the ring gear. Thus, as sun gear 372 rotates, hard disk substrates 374 revolve around central axes 375 and rotate about their own central axes, polishing pads 360*a* and 370*a* operate to polish both the upper and lower surfaces of hard disk substrates 374.

Figure 5A:
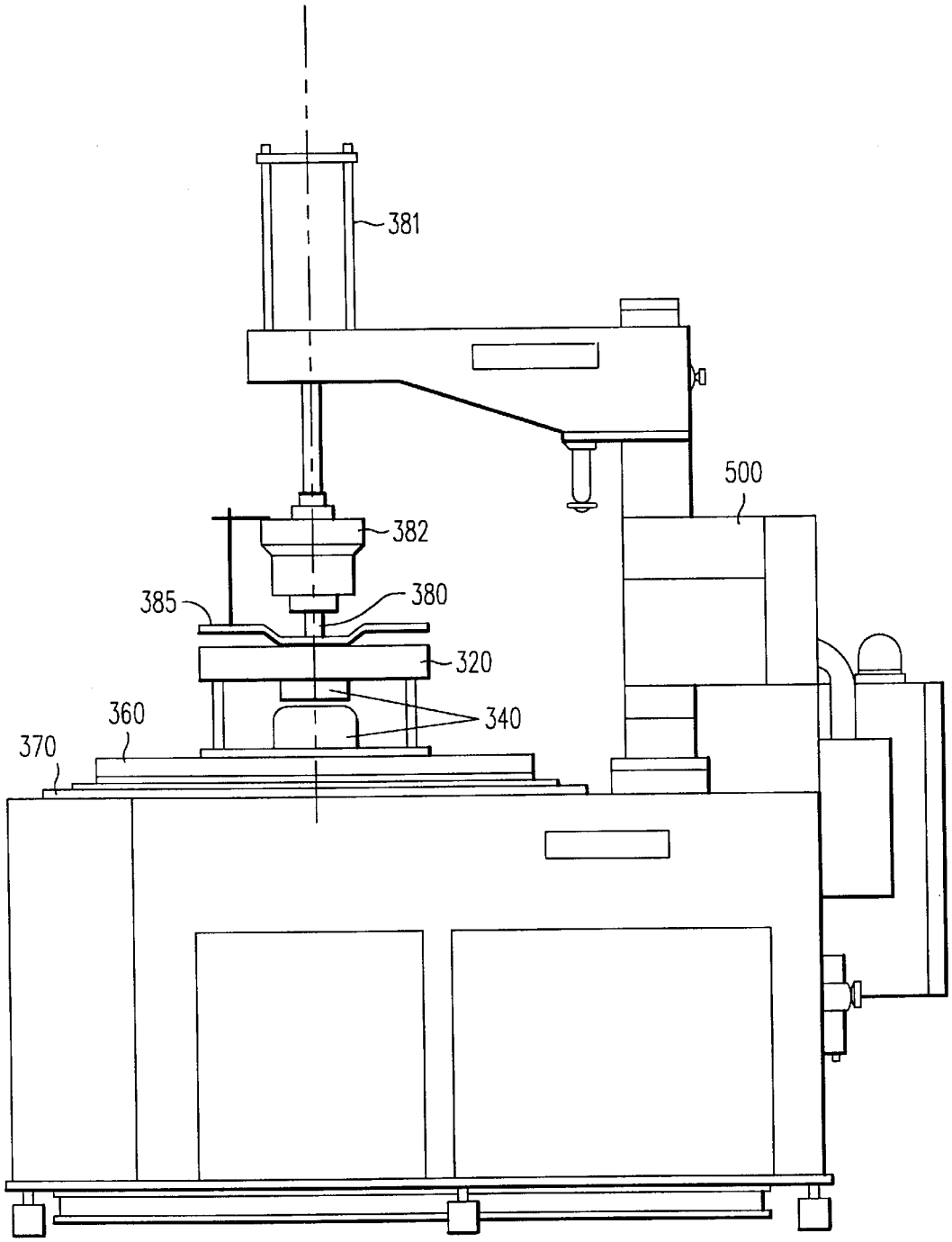
FIG. 5*a* is a side view of a complete planetary polishing machine in accordance with the present invention.
Figure 5B:
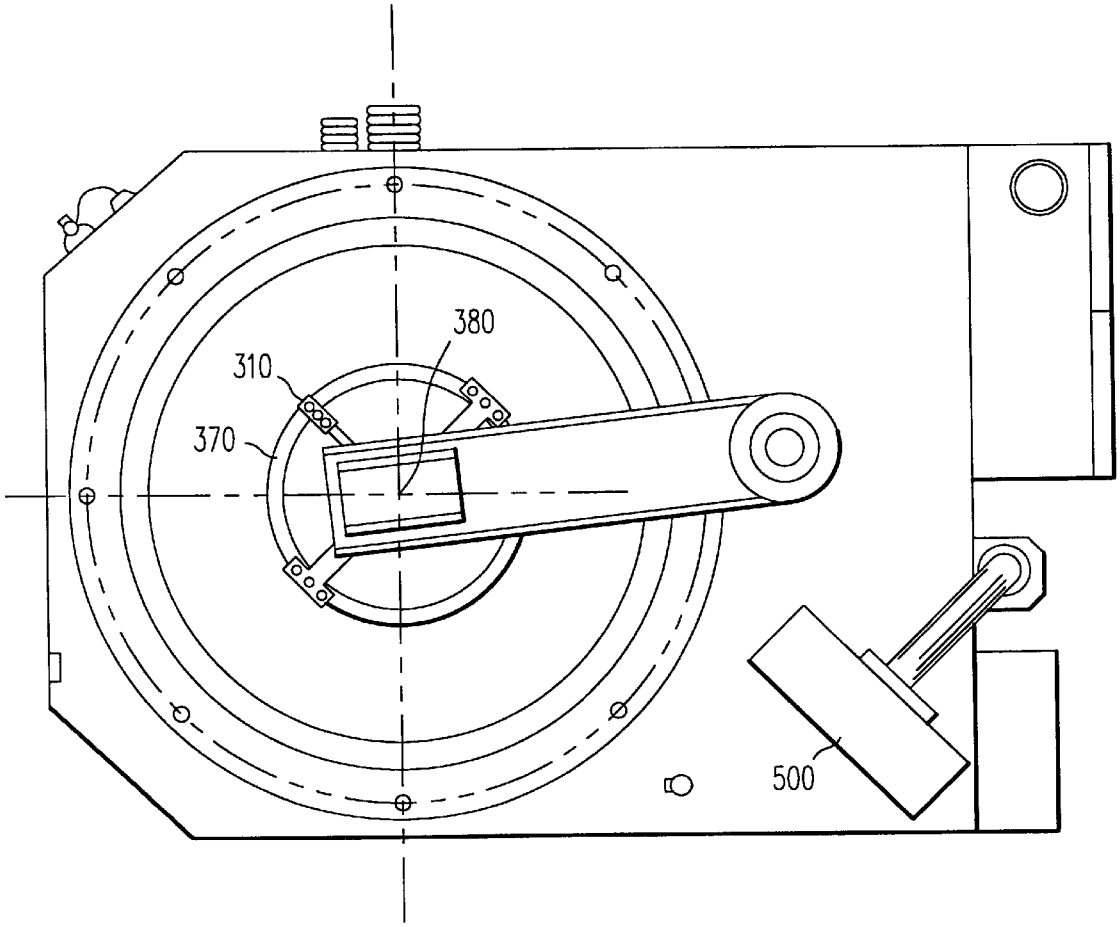
FIG. 5*b* is a top view of the planetary polishing machine in FIG. 5*a*.

FIG. 5 shows complete top and bottom views of planetary polishing machine 300 in accordance with the present invention, including computer control and read out 500. Although in one embodiment polishing machine 300 is a Speedfam model 16B polisher that has been adapted in accordance with the present invention, the principles of the invention are applicable to other planetary polishing machines which may be similarly adapted.

Figure 6:
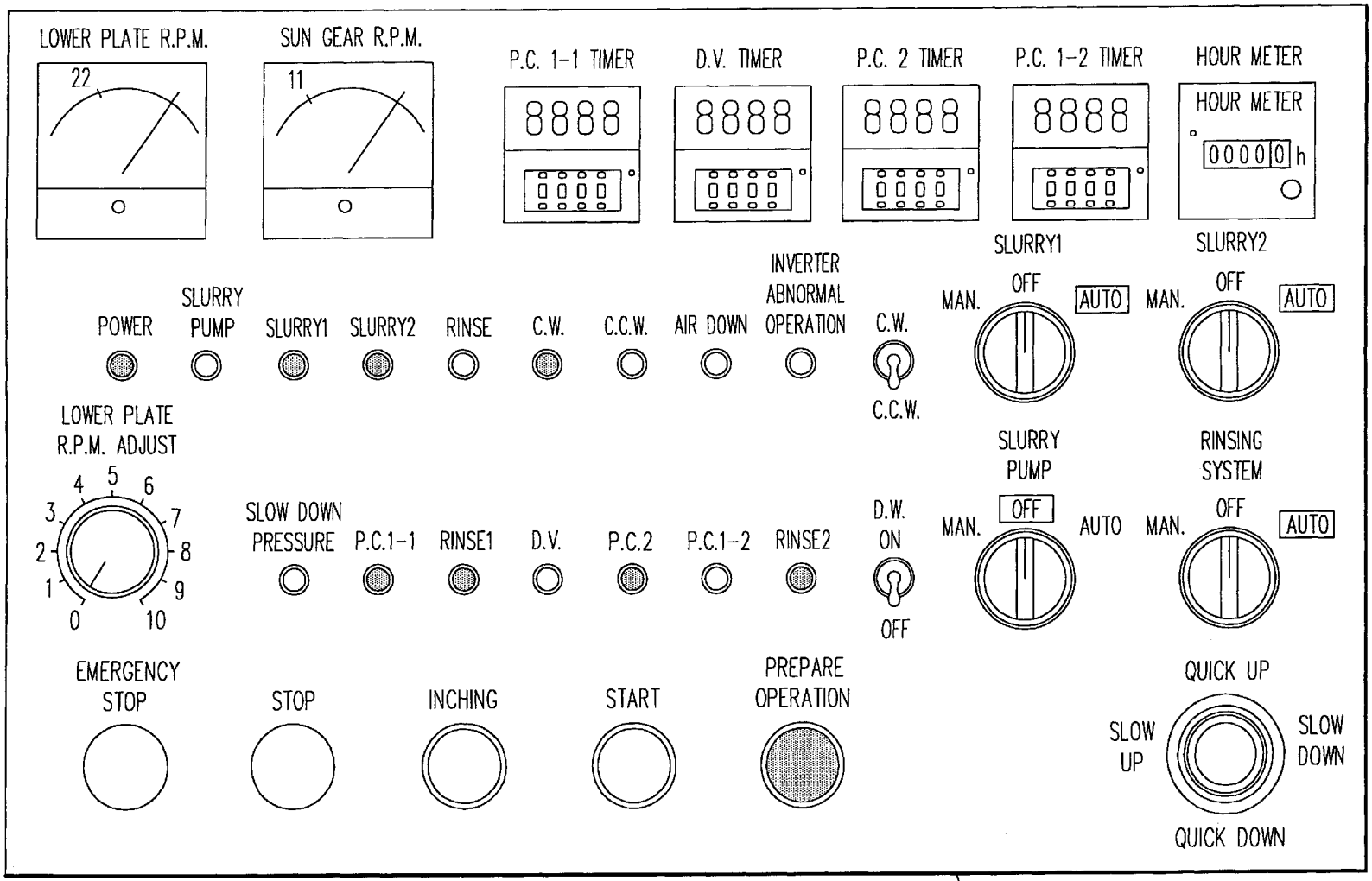
FIG. 6 is a view of the control panel of the planetary polishing machine.

FIG. 6 shows the face of the control panel 510 of polishing machine 300. At the upper left corner are two meters which indicate the rotational speeds of lower platen 370 and sun gear 372, respectively. The P.C. 1-1 timer contains the time setting for the initial polishing stage, the P.C. 2 timer contains the time setting for the final polishing stage. The P.C. 1-2 timer is not used in this embodiment. The DW (dead weight) timer is not used in this embodiment. The two knobs below the P.C. 1-2 timer are used to control the valves which admit the large-grit slurry and the small-grit slurry, referred to as "Slurry 1" and "Slurry 2", respectively, into the polishing machine. The lever at the bottom right corner controls the vertical movement of upper platen 360 and has settings for "Quick Up", "Quick Down", "Slow Up" and "Slow Down". The dial at the lower left controls the rotational speed of lower platen 370.

In order to perform the process of this invention, the Speedfam model 16B polisher was modified as follows:

1. An inlet port, solenoid valve and hose connections and fittings were provided for Slurry #2.
2. An on/off/auto toggle switch was installed in the control panel for Slurry #2, and the necessary connections were made between the toggle switch, the solenoid valve and the appropriate solenoid actuated air valve. The air valve is located in the pneumatic control panel of the machine.
3. The above components were tied in appropriately to the programmable logic control (PLC) which controls polishing machine 300.
4. A timer for the intermediate rinse cycle was programmed in in ladder logic software in the PLC. The logic ladder diagram is the graphical interface provided by the PLC, which provides the logical symbols and linkages (relays, inputs, outputs, timers, etc.) that are used to set up the control system.

In one embodiment, a coarse abrasive known as MDS 401 is mixed with water to produce slurry 1, the coarse-grained slurry used for the initial polishing stage, and an abrasive known as RDD 2452 is mixed with water to produce slurry 2, the finer grained slurry used for the final polishing stage. Both MDS 401 and RDD 2452 are available from Fujimi Corporation and are distributed by Speedfam Corporation of Chandler, Ariz. MDS 401 has a maximum particle size of 5.04 $\mu$m and a particle size distribution of D10 3.0±0.5 $\mu$m; D50 1.3±0.3 $\mu$m; D90 0.6±0.1 $\mu$m (D10, D50 and D90 representing the largest 10% of the particles, the median-sized particles and the smallest 10% of the particles, respectively). RDD 2452 has a mean particle size of 0.65 $\mu$m, a pH of 3.8, a Baume weight percentage of 20±0.5, and a specific gravity of 1.15.

While slurries other than MDS 401 may be used in accordance with the present invention, these other slurries must share some basic properties with MDS 401. For example, MDS 401 breaks down into smaller-sized grit particles during the initial polishing stage. Thus, MDS 401 has the advantage that even if all of the MDS 401 slurry particles are not rinsed from the polishing chamber after the initial polishing stage, the remaining slurry particles are small enough that they will not scratch the surface of the hard disk substrate during final polishing stage. The particles are also small enough that they are easily rinsed from the machine chamber after the final polishing. In addition, the pH of the slurry cannot be either too high or too low. If the pH is too low (acidic), the slurry may cause pitting on the hard disk substrate surface. If the pH is too high (alkaline), the slurry may not remove ripples on the hard disk substrate surface fast enough, thus adding time to the polishing process.

In one embodiment of the present invention, polishing pads with a thickness of 0.86–1.12 mm, a vertical pore height of 0.43–0.58 mm, a microporous thickness of 0.03–0.28 mm, and a compressibility of 10.2% are used, such as the Politex Supreme—DG [37-20] STD manufactured by Rodel, Inc. of Newark, Del. Polishing pads with similar properties may be used. However, the pads used should have a nap that does not trap any slurry particles, but instead allows the slurry particles to roll off the nap during polishing and rinse.

In accordance with the present invention, slurry 1 is formed by mixing MDS 401 with deionized (DI) water (18 Mega-ohms) in a ratio of 1 to approximately 0.75–3.0 (preferably 0.75–1.5); slurry 2 is formed by mixing RDD 2452 with DI water (18 Mega-ohms) in a ratio of 1 to approximately 1.0–3.5 (preferably 1.0–1.5).

Referring to FIGS. 4*a* and 4*b* again, the method of using these slurries will now be described. Hard disk substrates 374 are placed in carriers 373, and upper platen 360 is lowered to the point where polishing pad 360*a* rests on the upper surfaces of hard disk substrates 374 at the landing pressure, thereby pressing the bottom surfaces of hard disk substrates 374 against polishing pad 370*a*. The landing pressure is a pressure, lower than the pressure at which the substrates are polished, at which the polishing pads initially contact the surfaces of the substrates. By this process, polishing chamber 365 is formed.

Pressurized air is admitted into sub-cylinder 382 (FIG. 5*a*) through an air hose (not shown) to set the pressure (PC 1) of polishing pads 360*a* and 370*a* against the hard disk substrate surfaces at between 0.9 and 1.4 kg/cm$^2$. Sun gear 372 and lower platen 370 are rotated at a speed ratio of 1:2 (e.g., sun gear 372 at 10–15 r.p.m., lower platen 370 at 20–30 r.p.m.). As the platens begin to rotate, solenoid valve 330*a,* which is connected to tube 310*a,* is opened, and slurry 1 is introduced into polishing chamber 365 at between 280 and 340 ml/min for approximately 7–10 minutes, which is set by the P.C. 1-1 timer.

At the completion of the initial polishing stage solenoid valve 330*a,* which is connected to tube 310*a,* is closed. Solenoid valve 330*c,* which is connected to tube 310*c,* is opened, and DI rinse water (18 mega-ohms) is introduced into polishing chamber 365 at between 3000 and 4000 ml/min to flush slurry 1 from polishing chamber 365. The rinse water flows through the polishing chamber 365 and drains down to the tub and then out of the machine by gravity. The pressure remains at PC 1 during the rinse cycle, which typically lasts 30±10 seconds.

Solenoid valve 330*c* is then closed, and air is released from sub-cylinder 382 by an air hose (not shown) to reduce the pressure of polishing pads 360*a* and 370*a* against the hard disk substrate surfaces to a pressure (PC 2) between 0.7 and 0.9 kg/cm$^2$. Solenoid valve 330*b,* connected to tube 310*b,* is then opened, and slurry 2 is introduced into polishing chamber 365 at between 300 and 400 ml/min for approximately 2–4 minutes, which is the setting on the P.C. 2 timer.

Solenoid valve 330*b* is closed. Solenoid valve 330*c* is then reopened, and DI water (18 mega-ohms) is introduced into the polishing chamber 365 at between 3000 and 4000 ml/min (preferably 3600 ml/min) for about 30 seconds to flush slurry 2 from polishing chamber 365. During the rinse cycle the pressure is set at the landing pressure. The duration of the rinse cycle is set by a knob within the electrical control panel of the machine.

Spindle 380 is then stopped, and the lever is moved to the "Slow Up" to lift upper platen 360 from lower platen 370. The lever is then moved to the "Quick Up" position, and hard disk substrates 374 are removed from carriers 373.

Figure 7:
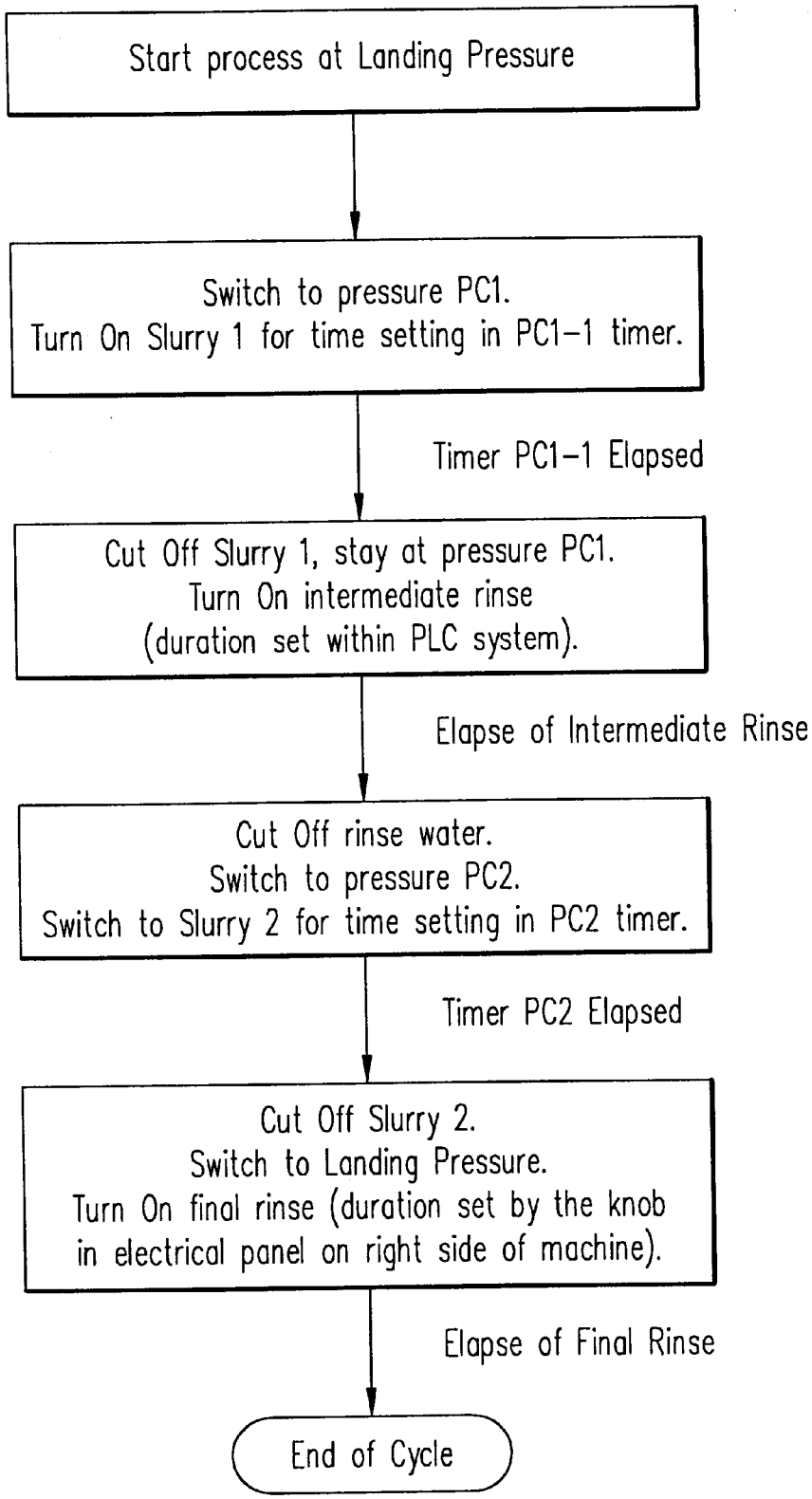
FIG. 7 shows a flowchart of the polishing process of this invention.

A flowchart describing the polishing process is shown in FIG. 7.

While there are ranges of values for the above flow rates, pressures, and times, these elements are mutually dependent and may only be altered together. For example, if the grit size in slurry 1 is increased, allowing for quicker polishing, the time for the initial polishing should be decreased; otherwise, the total polishing time will be longer than necessary and too much of the nickel phosphorous layer will be removed. Conversely, if the grit size in slurry 1 is decreased, the time required for the initial polishing should be increased; otherwise, the rough surfaces of the hard disk substrates will not be sufficiently smooth and the final polishing stage must be disproportionately increased to ensure that the hard disk substrate meets the required tolerance.

The following are the parameters for two exemplary processes:

| Example #1 | |
|---|---|
| Initial (coarse) polishing stage: | |
| MDS 401:water ratio in Slurry #1 | 1:0.75 |
| Flow rate of Slurry #1 | 300 ml/min |
| Pad pressure against disk | 1 kg/cm$^2$ |
| Duration | 9.00 min |
| Intermediate rinse cycle: | |
| Flow rate of rinse water | 3600 ml/min |
| Duration | 20 sec |
| Final (fine) polishing stage: | |
| RDD 2452:water ratio in Slurry #2 | 1:3 |
| Flow rate of Slurry #2 | 340 ml/min |
| Pad pressure against disk | 0.8 kg/cm$^2$ |
| Duration | 3.00 min |
| Final rinse cycle: | |
| Flow rate of rinse water | 3600 ml/min |
| Duration | 30 sec |
| **Example #2** | |
| Coarse polishing stage: | |
| MDS 401:water ratio in Slurry #1 | 1:0.75 |
| Flow rate of Slurry #1 | 340 ml/min |
| Pad pressure against disk | 1.2 kg/cm$^2$ |
| Duration | 8.50 min |
| Intermediate rinse cycle: | |
| Flow rate of rinse water | 3600 ml/min |
| Duration | 20 sec |
| Fine polishing stage: | |

-continued

| | |
|---|---|
| RDD 2452:water ratio in Slurry #2 | 1:2.5 |
| Flow rate of Slurry #2 | 340 ml/min |
| Pad pressure against disk | 0.8 kg/cm$^2$ |
| Duration | 2.50 min |
| Final rinse cycle: | |
| Flow rate of rinse water | 3600 ml/min |
| Duration | 30 sec |

The advantages in using the present invention are apparent. Under industry standards, the roughness average (R.A.), a standard that measures the average distance from peak to valley on the hard disk substrate surface, is approximately 20 to 32 $\mu$m; using the planetary polishing machine in accordance with the present invention, an R.A. of less than 10 $\mu$m has been achieved.

Thus, the principles of this invention may be implemented in a wide variety of machines and materials. Accordingly, the embodiments described above are only exemplary of the principles of the invention and are not intended to limit the invention to the specific embodiments disclosed.

We claim:

1. A machine for polishing flat substrates, said machine comprising:

a top platen, a first polishing pad being attached to a bottom surface of said top platen;

a bottom platen, a second polishing pad being attached to a top surface of said bottom platen, said top and bottom platens capable of being juxtaposed so as to create a polishing chamber for polishing a flat substrate;

a first conduit for introducing a first abrasive slurry into said polishing chamber, a flow of said first slurry in said first conduit being controlled by a first valve; and a second conduit for introducing a second abrasive slurry into said polishing chamber, a flow of said second slurry in said second conduit being controlled by a second valve, wherein said first slurry has a grit larger than a grit of said second slurry.

2. The machine of claim 1 further comprising:

a sun gear;

a ring gear; and a circular carrier interposed between said top and bottom platens and having a plurality of pockets formed therein for retaining a plurality of said substrates, a peripheral edge of said carrier having teeth which mesh with said sun gear and said ring gear.

3. The machine of claim 1 further comprising a third conduit for introducing a rinse liquid into said polishing chamber.

4. A method for polishing a plated hard disk substrate, said method comprising:

forming a polishing chamber between a top platen and a bottom platen;

placing at least one plated hard disk substrate in said polishing chamber;

creating a relative rotational movement between said top and bottom platens;

introducing a first abrasive slurry having a first grit into said polishing chamber so as to produce a first finish on a surface of said at least one plated substrate; and introducing a second abrasive slurry having a second grit into the polishing chamber so as to produce a second finish on said surface of said at least one substrate, wherein said first grit is larger than said second grit such that said first finish is coarser than said second finish.

5. The method of claim 4 further comprising introducing a rinse liquid into said polishing chamber between introducing the first abrasive slurry and introducing the second abrasive slurry.

6. The method of claim 4 wherein introducing the first abrasive slurry comprises introducing the first slurry at a flow rate between about 280 and 340 ml/min.

7. The method of claim 4 wherein introducing the second abrasive slurry comprises introducing the second slurry at a flow rate between about 300 and 400 ml/min.

8. The method of claim 5 wherein introducing the rinse liquid comprises introducing the rinse liquid at a flow rate between about 3000 and 4000 ml/min.

9. The method of claim 8 wherein introducing the rinse liquid comprises introducing deionized water with a purity equivalent to a resistance of about 18 Mega-ohms.

10. The method of claim 4 wherein introducing a first abrasive slurry comprises introducing a slurry containing abrasive particles which generally break down in the process of producing said first finish.

11. The method of claim 4 wherein introducing a first abrasive slurry comprises introducing a slurry containing abrasive particles having a maximum size of about 5 microns.

12. The method of claim 11 wherein introducing a first abrasive slurry comprises introducing a slurry containing abrasive particles having a size distribution of 3.0±0.5 $\mu$m for the largest 10% of the particles, 0.6±0.1 $\mu$m for the smallest 10% of the particles, and 1.3±0.3 $\mu$m for the remaining particles.

13. The method of claim 4 wherein introducing a first abrasive slurry comprises introducing a slurry containing abrasive particles having a size distribution of 3.0±0.5 $\mu$m for the largest 10% of the particles, 0.6±0.1 $\mu$m for the smallest 10% of the particles, and 1.3±0.3 $\mu$m for the remaining particles.

* * * * *